US011227561B2

(12) United States Patent
Chen et al.

(10) Patent No.: US 11,227,561 B2
(45) Date of Patent: Jan. 18, 2022

(54) DISPLAY DRIVER CIRCUIT SUITABLE FOR APPLICATIONS OF VARIABLE REFRESH RATE

(71) Applicant: NOVATEK Microelectronics Corp., Hsinchu (TW)

(72) Inventors: Chieh-Cheng Chen, Changhua County (TW); Chih-Chia Kuo, Hsinchu (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 16/805,818

(22) Filed: Mar. 1, 2020

(65) Prior Publication Data

US 2021/0272529 A1 Sep. 2, 2021

(51) Int. Cl.
*G09G 3/36* (2006.01)

(52) U.S. Cl.
CPC ... *G09G 3/3618* (2013.01); *G09G 2300/0478* (2013.01); *G09G 2310/0251* (2013.01); *G09G 2320/0219* (2013.01); *G09G 2320/0247* (2013.01)

(58) Field of Classification Search
None
See application file for complete search history.

(56) References Cited

U.S. PATENT DOCUMENTS

2002/0154073 A1* 10/2002 Kojima ..... G09G 3/2944 345/60
2016/0148563 A1* 5/2016 Tsuge ..... G09G 3/3233 345/76
2018/0277034 A1* 9/2018 Kim ..... G09G 3/3225

* cited by examiner

*Primary Examiner* — Aneeta Yodichkas
(74) *Attorney, Agent, or Firm* — CKC & Partners Co., LLC

(57) ABSTRACT

A display driver circuit, configured to drive a display panel, includes a time recording circuit, a storage circuit, and an output control circuit. The time recording circuit calculates a first time interval between a first vertical synchronous pulse and a second vertical synchronous pulse subsequent to the first vertical synchronous pulse. The storage circuit stores a display data corresponding to the first vertical synchronous pulse when the first vertical synchronous pulse is received by the display driver circuit. The output control circuit is coupled with the time recording circuit and the storage circuit. When the display driver circuit receives the second vertical synchronous pulse, the output control circuit outputs data pieces, generated by dividing the display data, to the display panel. The data pieces are outputted at second time intervals, and each of the second time intervals is positively correlated with the first time interval.

15 Claims, 5 Drawing Sheets

DISPLAY DRIVER CIRCUIT SUITABLE FOR APPLICATIONS OF VARIABLE REFRESH RATE

BACKGROUND

Field of Invention

The present disclosure generally relates to a display driver circuit. More particularly, the present disclosure relates to a display driver circuit capable of compensating luminance degradation in respect of variable of refresh rate.

Description of Related Art

Variable refresh rate technology eliminates screen tearing by allowing a display device to adapt to the frame rate of a video source (e.g. the graphics card or integrated graphics). When the video source outputs in a low frame rate, the display device is required to temporarily stop refreshing the voltages stored in the pixels, however, if the display device is a liquid crystal display (LCD), the luminance of the display device will gradually degrade because of the leakage currents of the liquid crystal capacitors. As a result, the user will experience noticeable flicker during the low frame rate period.

SUMMARY

The disclosure provides a display driver circuit configured to drive a display panel. The display driver circuit includes a time recording circuit, a storage circuit, and an output control circuit. The time recording circuit is configured to calculate a first time interval between a first vertical synchronous pulse and a second vertical synchronous pulse subsequent to the first vertical synchronous pulse. The storage circuit is configured to store a display data corresponding to the first vertical synchronous pulse when the first vertical synchronous pulse is received by the display driver circuit. The output control circuit is coupled with the time recording circuit and the storage circuit. When the display driver circuit receives the second vertical synchronous pulse, the output control circuit outputs a plurality of data pieces to the display panel. The plurality of data pieces are generated at least by dividing the display data. The plurality of data pieces are outputted at a plurality of second time intervals, and each of the plurality of second time intervals is positively correlated with the first time interval.

The disclosure further provides a display driver circuit configured to drive a display panel. The display driver circuit includes a time recording circuit, a storage circuit, and an output control circuit. The time recording circuit is configured to calculate a first time interval between a first vertical synchronous pulse and a second vertical synchronous pulse subsequent to the first vertical synchronous pulse. The storage circuit is configured to store a display data corresponding to the first vertical synchronous pulse when the first vertical synchronous pulse is received by the display driver circuit. The output control circuit is coupled with the time recording circuit and the storage circuit. When the display driver circuit receives the second vertical synchronous pulse, the output control circuit outputs a plurality of data duplications to the display panel. Each of the plurality of data duplications is generated at least by duplicating the display data. A number of the plurality of data duplications is positively correlated with the first time interval.

It is to be understood that both the foregoing general description and the following detailed description are by examples, and are intended to provide further explanation of the disclosure as claimed.

DETAILED DESCRIPTION

Figure 1:
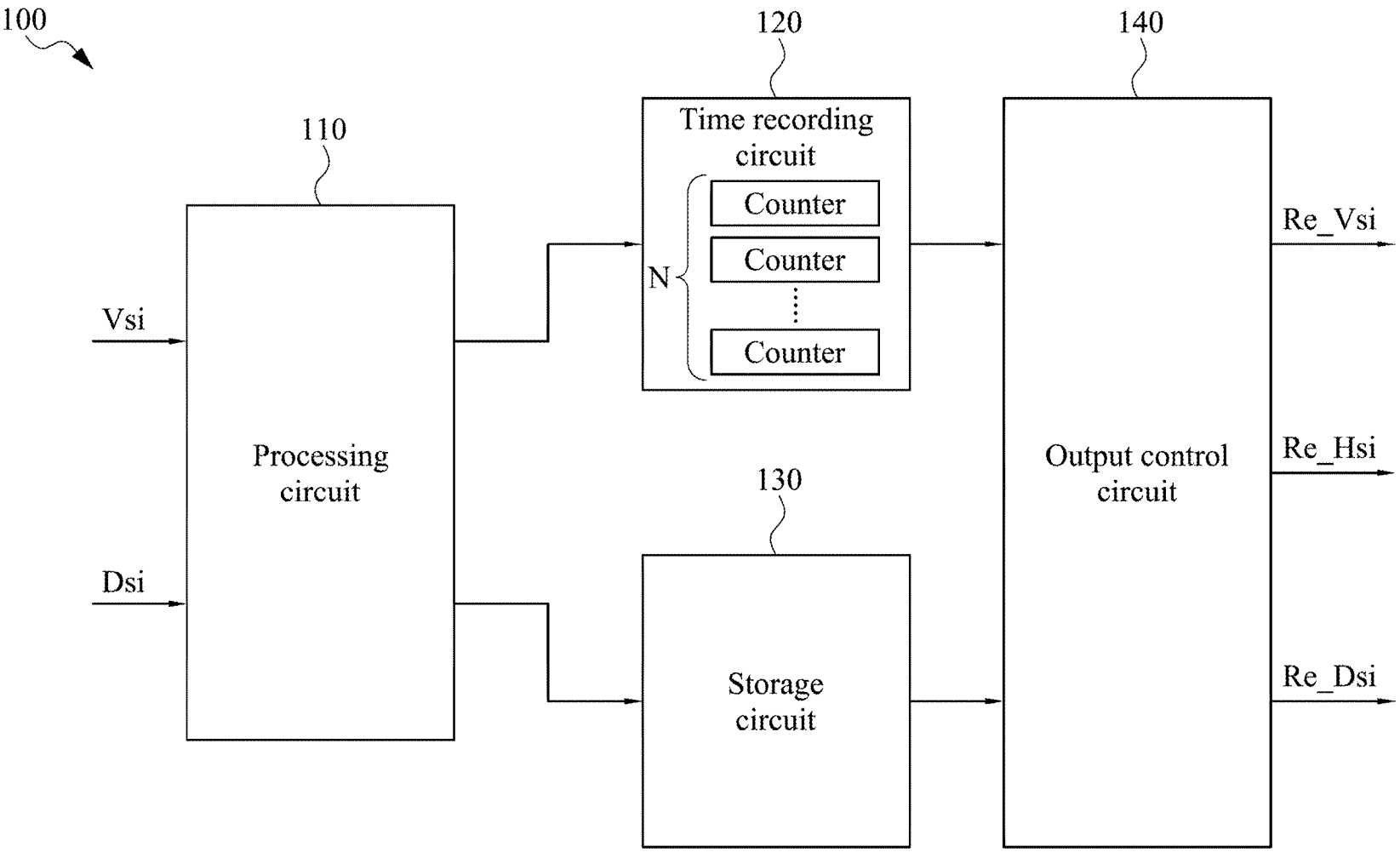
FIG. 1 is a simplified functional block diagram of a display driver circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display driver circuit 100 according to one embodiment of the present disclosure. The display driver circuit 100 comprises a processing circuit 110, a time recording circuit 120, a storage circuit 130, and an output control circuit 140. The time recording circuit 120 and the storage circuit 130 are coupled between the processing circuit 110 and the output control circuit 140. The display driver circuit 100 is capable of compensating luminance degradation in respect of the variable refresh rate. For the sake of brevity, other functional blocks of the display driver circuit 100 are not shown in FIG. 1.

Figure 2:
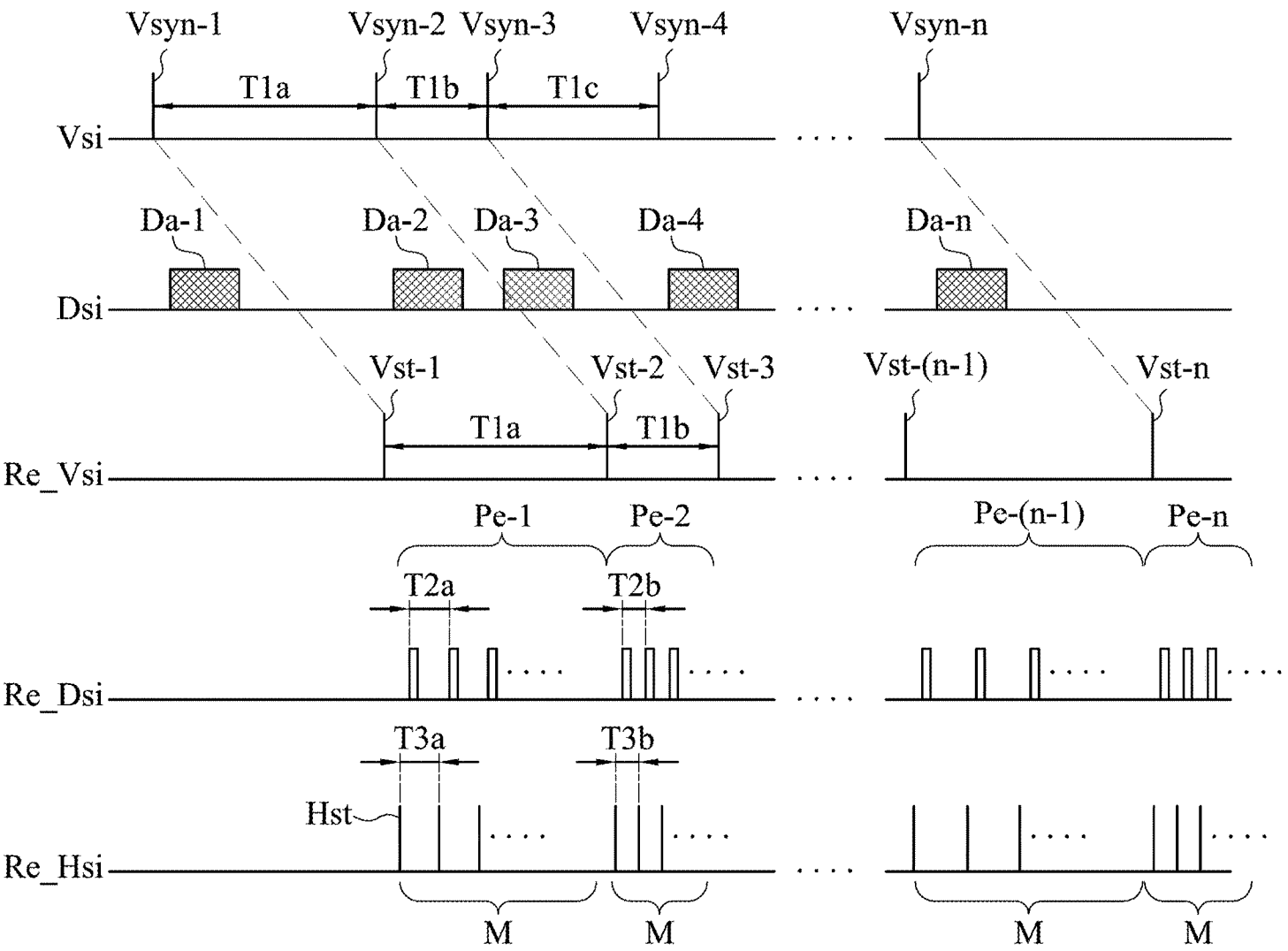
FIG. 2 is a simplified timing diagram of a plurality of signals provided to or outputted by the display driver circuit according to one embodiment of the present disclosure.

FIG. 2 is a simplified timing diagram of a plurality of signals provided to or outputted by the display driver circuit 100 according to one embodiment of the present disclosure. Reference is made to FIG. 1 and FIG. 2, the processing circuit 110 is configured to receive a vertical synchronous signal Vsi and a data signal Dsi from an external video source (e.g. the graphics card or integrated graphics, not shown in FIG. 1). The vertical synchronous signal Vsi is configured to provide a plurality of vertical synchronous pulses Vsyn-1~Vsyn-n to the processing circuit 110, and each vertical synchronous pulse Vsyn is configured to specify a start point of one frame. The data signal Dsi is configured to provide a plurality of display data Da-1~Da-n to the processing circuit 110. Each display data Da is provided subsequent to a corresponding vertical synchronous pulse Vsyn, and is configured to specify grayscale (brightness) to pixels PX of a display panel 500 of FIG. 5 so as to form an image of one frame. The display panel 500 is configured to be driven by the display driver circuit 100, which will be described in the following paragraphs.

Throughout the specification and drawings, indexes 1~n may be used in the reference labels of information and pulses provided by signals for ease of referring to respective information and pulses. The use of indexes 1~n does not intend to restrict the amount of information and pulses to any specific number. In the specification and drawings, if a reference label of particular information or pulse is used without having the index, it means that the reference label is used to refer to any unspecific information or pulse of corresponding information group or pulse group. For example, the reference label Vsyn-1 is used to refer to the specific vertical synchronous pulse Vsyn-1, and the reference label Vsyn is used to refer to any unspecific vertical synchronous pulse among vertical synchronous pulses Vsyn-1~Vsyn-n. In another example, the reference label Da-1 is used to refer to the specific display data Da-1, and the reference label Da is used to refer to any unspecific display data among the display data Da-1~Da-n.

The time recording circuit 120 is configured to record time intervals which each between two adjacent vertical synchronous pulses Vsyn, for example, the time recording circuit 120 may record the first time intervals T1*a*, T1*b*, and T1*c* shown in FIG. 2. In specific, the time recording circuit 120 comprises N counters, and each counter is configured to record a time interval between two adjacent vertical synchronous pulses Vsyn, in which N is an integer larger than 1. The recorded time intervals may be used to generate other signal which can be substantially deemed as the delayed vertical synchronous signal Vsi, which will be further described in the following paragraphs.

The processing circuit 110 may conduct variety image processing operations to the received display data Da-1~Da-n, such as image scaling, analog to digital conversion, and/or audio/video encoding and decoding. The processing circuit 110 is configured to store the processed display data Da-1~Da-n to the storage circuit 130. In some embodiments, the processing circuit 110 may be realized by a combination of one or more of a scaler IC, an analog-to-digital converter, a micro-processor, and a transition minimized differential signaling (TMDS) receiver. In other embodiments, the storage circuit 130 may be realized by various non-volatile or volatile memory circuits.

The output control circuit 140 is configured to provide a regenerated vertical synchronous signal Re_Vsi, a regenerated horizontal synchronous signal Re_Hsi, and a regenerated data signal Re_Dsi, where these signals may be transmitted to the display panel 500. The regenerated vertical synchronous signal Re_Vsi is configured to provide a plurality of vertical start pulses Vst-1~Vst-n. Each vertical start pulse Vst is configured to notify the display panel 500 to start to display a new frame, that is, to start to update the pixels PX thereof from the first row of pixels PX. The horizontal synchronous signal Re_Hsi is configured to provide a plurality of horizontal start pulses Hst.

Each of the horizontal start pulses Hst is configured to notify the display panel 500 to start to update a corresponding row of pixels PX. The regenerated data signal Re_Dsi is configured to provide a plurality of data piece groups Pe-1~Pe-n, where each data piece group Pe comprises a plurality of data pieces. Each data piece is configured to specify grayscale (brightness) to pixels PX disposed at one or more rows of the display panel 500.

A time interval (e.g., the first time intervals T1*a*, T1*b*, or T1*c*) between any two adjacent vertical synchronous pulses Vsyn represents the length of one frame. The output control circuit 140 may generate the regenerated vertical synchronous signal Re_Vsi by delaying the vertical synchronous signal Vsi for one frame by using the time intervals recorded by the time recording circuit 120. In other words, each vertical start pulse Vst is generated by delaying a corresponding vertical synchronous pulse Vsyn for approximately one frame.

For example, the time recording circuit 120 records the first time interval T1*a* between the vertical synchronous pulses Vsyn-1 and Vsyn-2. Then, the vertical start pulse Vst-1 is outputted after the vertical synchronous pulse Vsyn-2 is received by the processing circuit 110, and the vertical start pulse Vst-2 is separated from the vertical start pulse Vst-1 by the first time interval T1*a*.

As another example, the time recording circuit 120 records the first time interval T1*b* between the vertical synchronous pulses Vsyn-2 and Vsyn-3. The vertical start pulse Vst-2 is outputted after the vertical synchronous pulse Vsyn-3 is received by the processing circuit 110, and the vertical start pulse Vst-3 is separated from the vertical start pulse Vst-2 by the first time interval T1*b*.

In some embodiments, the number of the N counters included by the time recording circuit 120 is set to be larger than or equal to a result of a maximum refresh rate of the display panel 500 divided by a minimum refresh rate of the display panel 500, so as to completely store the appearance pattern of the vertical synchronous pulses Vsyn-1~Vsyn-n.

Each data piece group Pe is generated at least by dividing a corresponding processed display data Da into a plurality of data pieces, and is provided between two corresponding vertical start pulses Vst. For example, the data piece group Pe-1 is generated by dividing the processed display data Da-1, and is provided between the vertical start pulses Vst-1 and Vst-2. As another example, the data piece group Pe-2 is generated by dividing the processed display data Da-2, and is is provided between the vertical start pulses Vst-2 and Vst-3.

In this embodiment, the output control circuit 140 may divide the processed display data Da-1~Da-n retrieved from the storage circuit 130 to generate the data piece groups Pe-1~Pe-n, respectively, but this disclosure is not limited thereto. In some embodiments, the processing circuit 110 may divide the processed display data Da-1~Da-n in advance and store the obtained data pieces into the storage circuit 130.

Data pieces of the data piece group Pe are provided at corresponding time intervals which are positively correlated to the time interval between two corresponding vertical start pulses Vst. Therefore, the data pieces of the data piece group Pe are substantially evenly distributed between the two corresponding vertical start pulses Vst.

For example, the data pieces of the data piece group Pe-1 are provided at second time intervals T2*a*, and the data pieces of the data piece group Pe-2 are provided at second time intervals T2*b*. Since the first time interval T1*a* between the vertical start pulses Vst-1 and Vst-2 is two times greater than the first time interval T1*b* between the vertical start pulses Vst-2 and Vst-3, the second time interval T2*a* is set to be approximately two times greater than the second time interval T2*b*.

In this embodiment, each of the data pieces is provided to the display panel 500 subsequent to a corresponding one of the horizontal start pulses Hst. M horizontal start pulses Hst are provided between two adjacent vertical start pulse Vst, where M is an integer and may be set to the vertical resolution of an active area of the display panel 500. The horizontal start pulses Hst between two adjacent vertical start pulses Vst are provided at corresponding time intervals which are positively correlated to the time interval between the two adjacent vertical start pulses Vst.

For example, the horizontal start pulses Hst between the vertical start pulses Vst-1 and Vst-2 are provided at third time intervals T3*a*, and the horizontal start pulses Hst between the vertical start pulses Vst-2 and Vst-3 are provided at third time intervals T3*b*. Since the first time interval T1*a* between the vertical start pulses Vst-1 and Vst-2 is two times greater than the first time interval T1*b* between the vertical start pulses Vst-2 and Vst-3, the third time interval T3*a* is set to be approximately two times greater than the third time interval T3*b*.

In specific, the time interval between two adjacent horizontal start pulses Hst may be determined based on the following formula, where the term "T1" is the time interval between two adjacent vertical start pulses Vst, and the term "T3" is the time interval between two adjacent horizontal start pulses Hst provided between the two adjacent vertical start pulses Vst.

$$T1 \approx T3 \times m \quad \text{(Formula 1)}$$

In some embodiments that each data piece is configured to specify grayscale to multiple rows of pixels PX, each data piece may be provided to the display panel 500 after every two or more of the horizontal start pulses Hst are provided. Therefore, the time interval between two adjacent data pieces may be approximately the same as or greater than that of two adjacent horizontal start pulses Hst.

In the circumstance that the display panel 500 is a liquid crystal display panel, the data pieces and the horizontal start pulses Hst substantially evenly distributed in one frame render the display panel 500 gradually charges rows of the liquid crystal capacitors during the whole frame regardless the length of the frame. The display panel 500 needs not to charge the liquid crystal capacitors only in the beginning period of a frame. As a result, the leakage degrees of liquid crystal capacitors are mitigated, which helps to mitigate luminance degradation of the display panel 500 in applications of variable refresh rate.

In some embodiments, when the display driver circuit 100 recognizes that a time interval (e.g., the first time interval T1*c*) between two adjacent vertical synchronous pulses Vsyn is shorter than a predetermined time length, the display driver circuit 100 may decide not to divide the corresponding processed display data Da. As a result, the output control circuit 140 may directly provide the corresponding processed display data Da to the display panel 500.

In other embodiments, the data pieces in this disclosure may be generated not only by dividing a corresponding display data Da, but also by multiplying the divided display data Da with a gain value. The gain value may be set to be positively correlated with the time interval between corresponding two adjacent vertical start pulses Vst. For example, the data pieces of the data piece group Pe-1 may be generated by multiplying the divided display data Da-1 with a first gain value, the data pieces of the data piece group Pe-2 may be generated by multiplying the divided display data Da-2 with a second gain value, where the first gain value is greater than the second gain value since the first time interval T1*a* is greater than the first time interval T1*b*.

Figure 3:
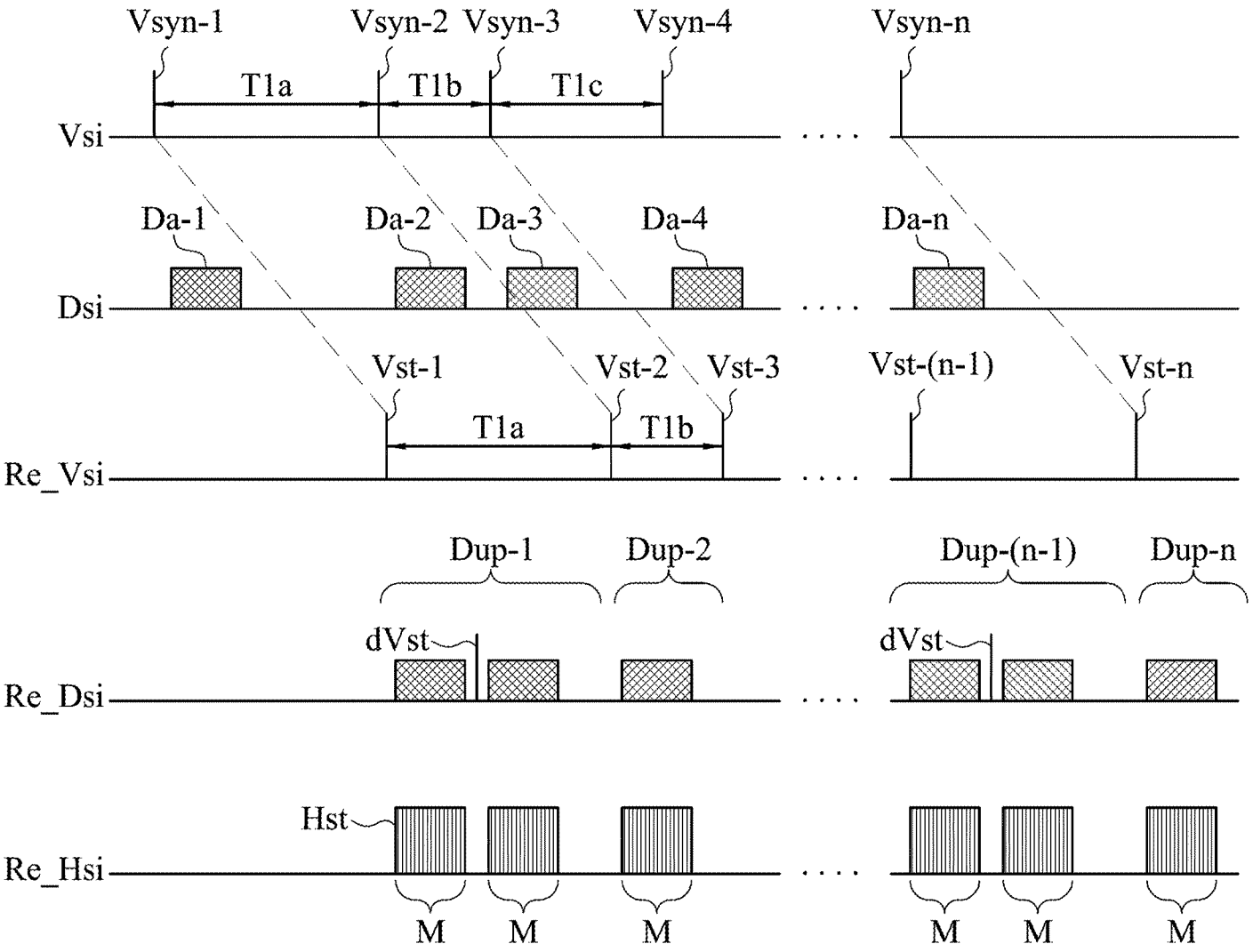
FIG. 3 is a simplified timing diagram of a plurality of signals provided to or outputted by the display driver circuit according to another embodiment of the present disclosure.

FIG. 3 is a simplified timing diagram of a plurality of signals provided to or outputted by the display driver circuit 100 according to one embodiment of the present disclosure. In this embodiment, the regenerated data signal Re_Dsi is configured to provide a plurality of data duplication groups Dup-1~Dup-n, where each data duplication group Dup is provided between two corresponding vertical start pulses Vst and comprises one or more data duplications generated at least by duplicating a corresponding display data Da. For example, the data duplication group Dup-1 comprises data duplications generated by duplicating the display data Da-1, the data duplication group Dup-2 comprises data duplications generated by duplicating the display data Da-2, and so on.

The output control circuit 140 may decide a number of data duplications in each data duplication group Dup according to the time intervals between each two adjacent vertical start pulses Vst. In specific, the number of data duplications included by the data duplication group Dup is positively correlated to the time interval between two corresponding adjacent vertical start pulses Vst. Between any two adjacent vertical start pulses Vst, the corresponding data duplications are substantially evenly distributed.

For example, the data duplication group Dup-1 is provided between the vertical start pulses Vst-1 and Vst-2, and the data duplication group Dup-2 is provided between the vertical start pulses Vst-2 and Vst-3. Since the first time interval T1*a* between the vertical start pulses Vst-1 and Vst-2 is two times greater than the first time interval T1*b* between the vertical start pulses Vst-2 and Vst-3, the number of data duplications included by the data duplication group Dup-1 may be twice of that of the data duplication group Dup-2.

In this embodiment, the output control circuit 140 may duplicate processed display data Da-1~Da-n retrieved from the storage circuit 130 to generate corresponding data duplications, but this disclosure is not limited thereto. In some embodiments, the processing circuit 110 may duplicate the processed display data Da-1~Da-n in advanced and store the obtained data duplications into the storage circuit 130.

In this embodiment, the regenerated vertical synchronous signal Re_Vsi is further configured to provide a plurality of dummy vertical start pulses dVst, and each of the dummy vertical start pulse dVst is provided between two adjacent data duplications. The dummy vertical start pulse dVst is configured to notify the display panel 500 to restart to update the pixels PX thereof from the first row of pixels PX. Moreover, the regenerated horizontal synchronous signal Re_Hsi may provide M horizontal start pulses Hst when each data duplication is transmitted, where M is an integer and may be set to the vertical resolution of the active area of the display panel 500.

In the circumstance that the display panel 500 is a liquid crystal display panel, the display driver circuit 100 is capable of instructing the display panel 500 to repeatedly update the whole active area during one frame. As a result, the leakage degrees of liquid crystal capacitors are mitigated, which helps to mitigate luminance degradation of the display panel 500 in applications of variable refresh rate. The foregoing descriptions regarding the other corresponding implementations, connections, operations, and related advantages of the embodiment of FIG. 2 are also applicable to the embodiment of FIG. 3. For the sake of brevity, those descriptions will not be repeated here.

In some embodiments, the data duplications in this disclosure may be generated not only by duplicating a corresponding display data Da, but also by multiplying the duplicated display data Da with a gain value. The gain value may be set to be positively correlated with the time interval between two corresponding vertical start pulses Vst. For example, the data duplications of the data duplication group Dup-1 may be generated by multiplying the duplicated display data Da-1 with a third gain value, the data duplications of the data duplication group Dup-2 may be generated by multiplying the duplicated display data Da-2 with a fourth gain value, where the third gain value is greater than the fourth gain value since the first time interval T1*a* is greater than the first time interval T1*b*.

Figure 4:
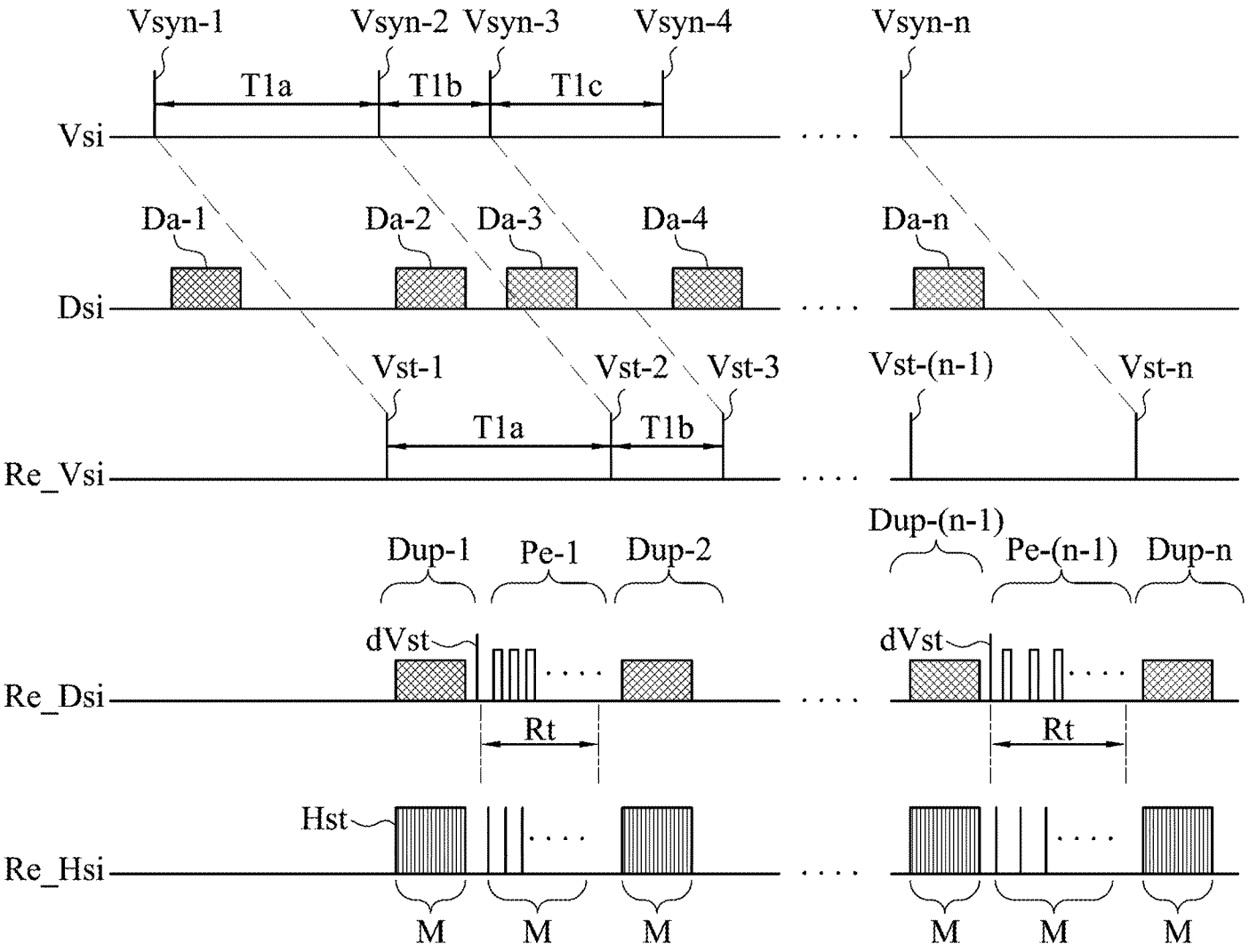
FIG. 4 is a simplified timing diagram of a plurality of signals provided to or outputted by the display driver circuit according to yet another embodiment of the present disclosure.

FIG. 4 is a simplified timing diagram of a plurality of signals provided to or outputted by the display driver circuit 100 according to one embodiment of the present disclosure. This embodiment is similar to the embodiment of FIG. 3, and the difference is that the output control circuit 140 may selectively provide a data piece group Pe subsequent to a data duplication group Dup between two adjacent vertical start pulses Vst. In specific, if a remaining time length Rt between the last data duplication of the data duplication group Dup and a next vertical start pulse Vst is enough for transmitting another data duplication but is not enough for transmitting more than one data duplications, the output control circuit 140 may provide the data piece group Pe after the last data duplication to fill the remain time length Rt.

For example, as shown in FIG. 4, after providing the data duplication group Dup-1, the output control circuit 140 further provide the data piece group Pe-1 subsequent to the data duplication group Dup-1, where each data pieces included by the data piece group Pe-1 is generated at least by dividing the display data Da-1.

In other words, the output control circuit 140 may replace the last data duplication in a data duplication group Dup with a corresponding data piece group Pe having data pieces provided at time intervals positively correlated with the remaining time length Rt.

Figure 5:
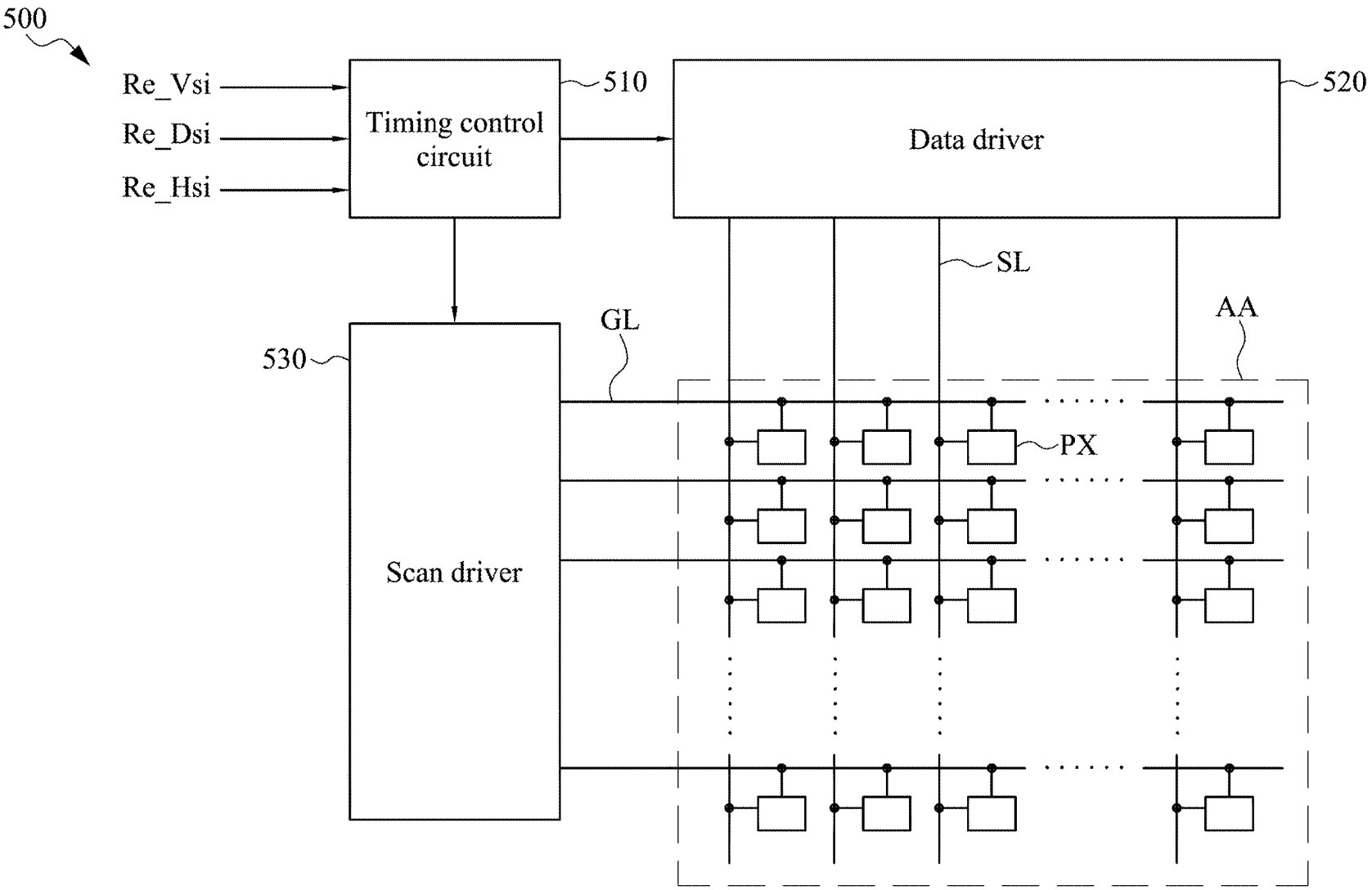
FIG. 5 is a simplified functional block diagram of a display panel according to one embodiment of the present disclosure.

FIG. 5 is a simplified functional block diagram of a display panel 500 according to one embodiment of the present disclosure. The display panel 500 comprises a timing control circuit 510, a data driver 520, a scan driver 530, and a plurality of pixels PX. The timing control circuit 510 is configured to be coupled with the display driver circuit 100, and configured to receive the regenerated vertical synchronous signal Re_Vsi, the regenerated horizontal synchronous signal Re_Hsi, and the regenerated data signal Re_Dsi from the display driver circuit 100. According to these signals received from the display driver circuit 100, the timing control circuit 510 may provide a plurality of clock signals to the data driver 520 and the scan driver 530, and further provide image data to the data driver 520.

The data driver 520 and the scan driver 530 are coupled with the pixels PX through a plurality of scan lines SL and a plurality of gate lines GL, respectively. The pixels PX are disposed at locations corresponding to the intersections of the scan lines SL and the gate lines GL, that is, the pixels PX form an array having rows and columns of pixels PX and located in an active area AA. The data driver 520 may provide the image data to the scan lines SL, and the scan driver 530 may control the time point in which the pixels PX receive the image data.

In some embodiments, the display driver circuit 100 is configured to calculate a current frame rate according to the time interval between the last two adjacent vertical start pulses Vst, for example, the current frame rate is 102 Hz when the time interval is 8.33 ms. The current frame rate may be transmitted to the timing control circuit 510 by the output control circuit 140.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display driver circuit, configured to drive a display panel comprising a first row of pixels and a second row of pixels, comprising:

a time recording circuit, configured to calculate a first time interval between a first vertical synchronous pulse and a second vertical synchronous pulse subsequent to the first vertical synchronous pulse;

a storage circuit, configured to store a display data corresponding to the first vertical synchronous pulse when the first vertical synchronous pulse is received by the display driver circuit; and an output control circuit, coupled with the time recording circuit and the storage circuit, wherein when the display driver circuit receives the second vertical synchronous pulse, the output control circuit outputs a plurality of data pieces, generated at least by dividing the display data, to the display panel, wherein the plurality of data pieces are outputted at a plurality of second time intervals, and each of the plurality of second time intervals is positively correlated with the first time interval, wherein the plurality of data pieces comprises a first data piece and a second data piece, and the first data piece and the second data piece are configured to specify grayscales to the first row of pixels and the second row of pixels, respectively, wherein the first row of pixels is different from the second row of pixels.

2. The display driver circuit of claim 1, wherein the time recording circuit comprises N counters, and N is an integer larger than 1, wherein N is equal to a result of a maximum frame rate of the display panel divided by a minimum frame rate of the display panel.

3. The display driver circuit of claim 2, further configured to receive a plurality of vertical synchronous pulses, wherein the plurality of vertical synchronous pulses comprise the first vertical synchronous pulse and the second vertical synchronous pulse, and each of the N counters is configured to record a corresponding time interval between two corresponding adjacent vertical synchronous pulses of the plurality of vertical synchronous pulses.

4. The display driver circuit of claim 1, wherein the output control circuit is further configured to output a first vertical start pulse and a second vertical start pulse to notify the display panel to correspondingly display a first frame and a second frame, the first vertical start pulse is outputted after the display driver circuit receives the second vertical synchronous pulse, the second vertical start pulse is outputted subsequently to the first vertical start pulse, and the first vertical start pulse and the second vertical start pulse are separated by the first time interval.

5. The display driver circuit of claim 4, wherein the plurality of data pieces are outputted between the first vertical start pulse and the second vertical start pulse.

6. The display driver circuit of claim 1, wherein the output control circuit is further configured to output a plurality of horizontal start pulses to the display panel at a plurality of third time intervals, and each of the plurality of horizontal start pulses is configured to notify the display panel to update a corresponding row of pixels, each of the plurality of third time intervals is positively correlated with the first time interval, and is different from or the same as each of the plurality of second time intervals.

7. The display driver circuit of claim 1, wherein the output control circuit is further configured to output a current frame rate, calculated according to the first time interval, to the display panel.

8. The display driver circuit of claim 1, wherein the plurality of data pieces are generated according to a result of the display data multiplying a gain value, and the gain value is positively correlated with the first time interval.

9. A display driver circuit, configured to drive a display panel, comprising:

a time recording circuit, configured to calculate a first time interval between a first vertical synchronous pulse and a second vertical synchronous pulse subsequent to the first vertical synchronous pulse;

a storage circuit, configured to store a display data corresponding to the first vertical synchronous pulse when the first vertical synchronous pulse is received by the display driver circuit; and an output control circuit, coupled with the time recording circuit and the storage circuit, wherein when the display driver circuit receives the second vertical synchronous pulse, the output control circuit outputs a plurality of data duplications to the display panel, and each of the plurality of data duplications is generated at least by duplicating the display data, wherein a number of the plurality of data duplications is positively correlated with the first time interval, wherein each of the plurality of data duplications is generated according to a result of the display data multiplying a gain value, and the gain value is positively correlated with the first time interval.

10. The display driver circuit of claim 9, wherein the time recording circuit comprises N counters, and N is an integer larger than 1, wherein N is equal to a result of a maximum frame rate of the display panel divided by a minimum frame rate of the display panel.

11. The display driver circuit of claim 10, further configured to receive a plurality of vertical synchronous pulses, wherein the plurality of vertical synchronous pulses comprise the first vertical synchronous pulse and the second vertical synchronous pulse, and each of the N counters is configured to record a corresponding time interval between two corresponding adjacent vertical synchronous pulses of the plurality of vertical synchronous pulses.

12. The display driver circuit of claim 9, wherein the output control circuit is further configured to output a first vertical start pulse and a second vertical start pulse to notify the display panel to correspondingly display a first frame and a second frame, the first vertical start pulse is outputted after the display driver circuit receives the second vertical synchronous pulse, the second vertical start pulse is outputted subsequently to the first vertical start pulse, and the first vertical start pulse and the second vertical start pulse are separated by the first time interval.

13. The display driver circuit of claim 12, wherein the plurality of data duplications are outputted between the first vertical start pulse and the second vertical start pulse.

14. The display driver circuit of claim 9, wherein the output control circuit is further configured to output a current frame rate, calculated according to the first time interval, to the display panel.

15. The display driver circuit of claim 9, wherein after outputting the plurality of data duplications, the output control circuit outputs a plurality of data pieces, generated at least by dividing the display data, to the display panel.

* * * * *